United States Patent [19]

Preuss

[11] Patent Number: 4,850,073

[45] Date of Patent: Jul. 25, 1989

[54] NAPPED FIBER BRUSH FOR CLEANING TEXTILE FABRICS

[76] Inventor: Herbert Preuss, Bruchgasse 9, 6070 Langen, Fed. Rep. of Germany

[21] Appl. No.: 162,320

[22] PCT Filed: Mar. 31, 1987

[86] PCT No.: PCT/EP87/00175

§ 371 Date: Feb. 17, 1988

§ 102(e) Date: Feb. 17, 1988

[87] PCT Pub. No.: WO87/06110

PCT Pub. Date: Oct. 22, 1987

[30] Foreign Application Priority Data

Apr. 17, 1986 [DE] Fed. Rep. of Germany ..... 3612980
Jun. 12, 1986 [DE] Fed. Rep. of Germany ..... 3619781

[51] Int. Cl.[4] ..... A46B 9/02

[52] U.S. Cl. ..... 15/159 A; 15/160; 15/104 A; 15/210 R

[58] Field of Search ..... 15/159 A, 160, 171, 15/231, 232, 233, 48, 38, 104 A, 104 R, 210 R, 1.5 A

[56] References Cited

U.S. PATENT DOCUMENTS 3,346,900 10/1967 Stewart et al. ..... 15/160
3,747,152 7/1973 Tsuruzawa ..... 15/160 X

FOREIGN PATENT DOCUMENTS 2100465 7/1972 Fed. Rep. of Germany .

*Primary Examiner*—Peter Feldman
*Attorney, Agent, or Firm*—Robert J. Koch

[57] ABSTRACT

Fiber pile brush for the cleaning of textile fabrics comprising a support provided with a synthetic fiber pile covering, for example of nylon velour with unidirectionally oriented pile fibers wherein the fiber pile covering is divided along a direction extending perpendicularly to the (customary) working direction and the parts (2, 3) of the covering are attached with inwardly opposing orientations of the pile to the support (1). Between the parts (2, 3) of the covering a zone without a covering is provided, in which a channel-like recessed insert (4), made for example of a plastic, is located as a collecting container for the dirt particles brushed off.

3 Claims, 1 Drawing Sheet

FIG. 1
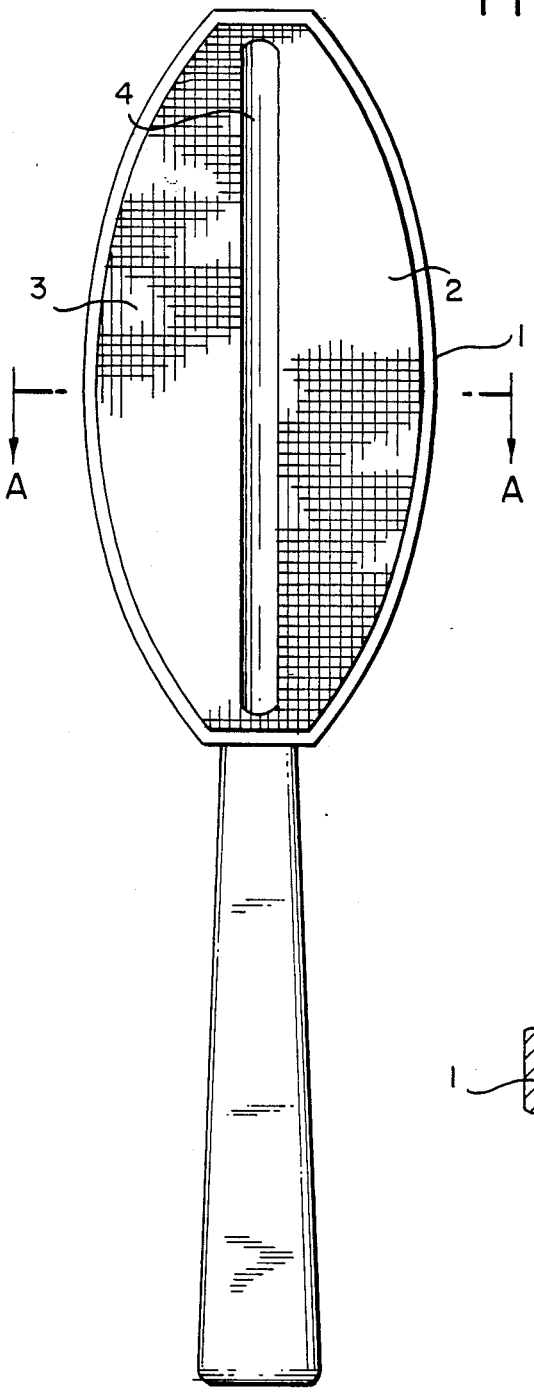
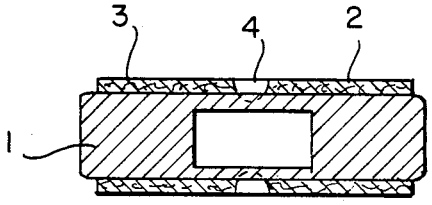
FIG. 2

NAPPED FIBER BRUSH FOR CLEANING TEXTILE FABRICS

The invention concerns a fiber pile brush for the cleaning of textile fabrics, comprising a support provided with a synthetic fiber pile covering of, for example nylon velour, having unidirectionally oriented pile fibers.

Fiber pile brushes of the above-described type have proved themselves to the extent that the unidirectional alignment of the pile provides an excellent cleaning effect during movement of the brush against the fiber pile direction. Lint and dust particles are not brushed into the environment after removal, but are taken up by the fiber pile brush. In use, the removal action takes place only during movement of the brush against the pile fibers so that following each movement the brush must be lifted off and returned. In the case of left-handed persons, this movement works against their natural direction of motion. Further, dirt particles taken up collect and aggregate in the fiber pile. Consequently, even after a short period of time, the fiber pile covering becomes overloaded and particles are retransferred back to the fabric to be cleaned. It is therefore necessary to frequently clean the brush during use which is relatively difficult in view of the high retention force of the fiber pile covering.

It is an object of the present invention to create a fiber pile brush which cleans the fabric being treated independently of the direction of the brush motion.

The invention comprises a support head covered by a fiber pile covering which is divided along a direction extending perpendicularly to the working direction. Each side of the covering is attached to the support head with an opposing orientation of the pile covering.

As a result of this division and orientation arrangement it is possible to clean textile fabrics independently of direction. The same good results may be achieved by both left and right-handed persons without interruption of the brush movement.

Advantageously, the parts of the covering have inwardly opposing pile orientations. During the cleaning motion, the pile orientation opposing the movement takes up dust and lint particles from the fabric while the pile orientation aligned with the movement transports particles inwardly into the center zone. Particles may be taken off in a concentrated and collected form from this center zone.

In a further embodiment of the fiber pile brush according to the invention, a zone without a fiber pile covering is provided between the divided parts. A recessed insert may be located in this zone to form a collecting channel for removed lint. The insert may be plastic. The collecting channel may be cleaned by a simple motion of a finger. By providing a deeper channel, the receiving space may be correspondingly enlarged so that it is necessary to remove the dirt less frequently.

In this manner, an effect nearly approximating a self-cleaning action is obtained. Dust particles are taken up during the movement against the orientation of the fiber pile and are also transported toward the center of the brush during the motion in the fiber pile orientation.

The invention is shown as an example in the drawing, wherein:

FIG. 1 is a top elevation of the brush.

FIG. 2 shows a section through A—A in FIG. 1.

The fiber pile brush shown in the drawing for the cleaning of textile fabrics comprises a support head 1 and a synthetic fiber pile covering (for example, nylon velour) with unidirectionally oriented pile fibers. The fiber pile covering is divided along a direction extending perpendicularly to the (customary) working direction, and parts 2, 3 of the covering are attached to the support 1 with inwardly opposing pile orientations. In the embodiment shown, between parts 2 and 3 of the covering is a zone that is not covered by the fiber pile. A channel-shaped recessed insert 4 (made for example of plastic) is located as a collecting container for the removed lint.

To clean a fabric, the brush is moved back and forth over the fabric in a direction approximately perpendicular to its longitudinal extension. As a result of the inwardly opposing orientation of the pile fibers, dirt particles are taken up during the brushing motion in both directions and transported toward the center, until they are collected in channel 4. From channel 4, the collected dirt particles may be removed periodically by a simple finger motion without difficulty. The risk of the recontamination of the fabric is largely eliminated.

I claim:

1. A brush comprising:

a support head;

a collection zone located on said support head and positioned perpendicularly to a working direction of said head; and a synthetic fiber pile covering including a first area of unidirectional fibers and a second area of unidirectional fibers, said first area and said second area attached to said support head on opposite sides of said collection zone wherein each area oriented with said unidirectional fibers is directed toward said collection zone, and said collection zone is configured as a shallow, recessed longitudinal channel in said support head extending substantially the length of said synthetic fiber pile.

2. A brush according to claim 1 wherein said fiber pile is made of nylon velour.

3. A brush according to claim 1 further comprising a shallow channel shaped member disposed in said collection zone.

* * * * *